US009779903B2

(12) United States Patent
Nereau

(10) Patent No.: US 9,779,903 B2
(45) Date of Patent: Oct. 3, 2017

(54) CIRCUIT BREAKER HAVING EQUALIZED POLES

(71) Applicant: Schneider Electric Industries SAS, Rueil Malmaison (FR)

(72) Inventor: Jean-Pierre Nereau, Seyssinet (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 19 days.

(21) Appl. No.: 14/820,651

(22) Filed: Aug. 7, 2015

(65) Prior Publication Data

US 2016/0079024 A1 Mar. 17, 2016

(30) Foreign Application Priority Data

Sep. 11, 2014 (FR) ..... 14 58539

(51) Int. Cl.

| | |
|---|---|
| ***H01H 27/10*** | (2006.01) |
| ***H01H 71/08*** | (2006.01) |
| ***H01H 33/59*** | (2006.01) |
| ***H01H 71/10*** | (2006.01) |
| ***H01H 71/12*** | (2006.01) |
| ***H01H 71/52*** | (2006.01) |

(52) U.S. Cl.

CPC ..... *H01H 71/082* (2013.01); *H01H 33/596* (2013.01); *H01H 71/08* (2013.01); *H01H 71/1045* (2013.01); *H01H 71/12* (2013.01); *H01H 71/52* (2013.01)

(58) Field of Classification Search

CPC ..... H01H 71/1045–73/00; H01H 73/02

USPC ..... 200/42.01; 335/8, 11, 12; 307/125; 361/59, 61, 91.1, 102

See application file for complete search history.

(56) References Cited

U.S. PATENT DOCUMENTS

| | | | | |
|---|---|---|---|---|
| 4,492,941 | A | 1/1985 | Nagel | |
| 6,034,586 | A * | 3/2000 | Runyan | H01H 71/1027 218/152 |
| 6,563,406 | B2 * | 5/2003 | Beatty | H01H 71/1045 335/147 |
| 7,119,642 | B2 * | 10/2006 | Flores | G01R 15/146 335/6 |
| 2006/0038448 | A1 | 2/2006 | Flores et al. | |

FOREIGN PATENT DOCUMENTS

| | | |
|---|---|---|
| DE | 24 02 092 A1 | 7/1975 |
| EP | 0 117 094 A1 | 8/1984 |
| EP | 0 702 387 A1 | 3/1996 |

OTHER PUBLICATIONS

French Preliminary Search Report issued May 5, 2015 in French Application 14 58539, filed on Sep. 11, 2014 (with English Translation of Categories of Cited Documents).

* cited by examiner

*Primary Examiner* — Vanessa Girardi
(74) *Attorney, Agent, or Firm* — Oblon, McClelland, Maier & Neustadt, L.L.P.

(57) ABSTRACT

The circuit breaker includes two polarities each including two poles connected in parallel, each pole having a switch and a tripping device. Each of the polarities has an equalizer electrically connecting the link between the switch and the tripping device of a first pole and the link between the switch and the tripping device of the second pole.

12 Claims, 3 Drawing Sheets

CIRCUIT BREAKER HAVING EQUALIZED POLES

The invention concerns a circuit breaker comprising two polarities each including two poles connected in parallel, each pole having a switch and a tripping device.

Some circuit breakers for direct current have poles in parallel, in order to increase the maximum use of current. Such a circuit breaker comprises two polarities each including two poles connected in parallel. Each pole has a tripping device, which can operate by overload and/or by short circuit, that is suited to detecting a current greater than half the total maximum current beyond which the circuit breaker is activated. Each pole likewise comprises a switch connected in series with the tripping device, this switch providing for the current to flow as a result of contact between conductive portions.

When two poles or more are connected in parallel, the current is distributed between these poles in a manner inversely proportional to the resistance of these poles. The resistance of a pole includes the resistance of all of the conductive portions and the contact resistance of the switch. The resistance of the conductive portions is very invariable, because it is dependent only on the resistivity of the materials, which has little scatter, and on the geometry of the portions, the tolerances of which are under control. The contact resistance, on the other hand, is subject to variations that may be substantial, owing to the electrical arcs that affect the surface of the fixed and mobile contacts both under continuous load and in the case of a short circuit. Therefore, the resistance of the two poles in parallel may be substantially different. A current of greater intensity will therefore naturally flow in the pole that has the lowest resistance, with the risk of causing the circuit breaker to trip for an excessively low total current value. The reason is that it is possible for the current flowing in the pole with the lowest resistance to exceed half the maximum current intensity, or the total current intensity is lower than the maximum current intensity. The circuit breaker therefore cannot perform its function satisfactorily and can cause untimely power cuts.

These are disadvantages that the invention aims to overcome by proposing a novel circuit breaker with poles connected in parallel, in which the distribution of the current in the poles is under better control and which avoids untimely tripping.

To this end, the invention concerns a circuit breaker comprising two polarities each including two poles connected in parallel, each pole having a switch and a tripping device. This circuit breaker is characterized in that each of the polarities has an equalizer electrically connecting the link between the switch and the tripping device of a first pole and the link between the switch and the tripping device of the second pole.

By virtue of the invention, the distribution of the current between the poles is affected in practice only by the difference in the resistance of the tripping devices. In point of fact, these tripping devices are made up of conductive portions of known resistance, and the resistance differences between the tripping elements are negligible in practice. The current imbalances between the poles connected in parallel are therefore small, which minimizes the risks of the circuit breaker tripping for excessively low total current values.

According to advantageous but non-obligatory aspects of the invention, such a circuit breaker can incorporate one or more of the following features, taken in any technically admissible combination:

- The value of the resistance of the equalizer is no more than at the same order of magnitude as the value of the resistance of the tripping devices.
- The value of the resistance of the equalizer is less than three times the value of the resistance of the tripping devices.
- The equalizer is a conductive bow.
- The conductive bow has two fixing lugs provided with holes.
- The conductive bow is fixed by screws.
- The equalizers are cables or braids of conductive wires.
- The equalizers are fixed to the conductive portions of the tripping devices that form the links between the switches and the tripping devices.
- The equalizers are fixed to the conductive portions of the switches that form the links between the switches and the tripping devices.
- The equalizer is a bow comprising lateral branches formed by conductive portions of two adjacent tripping devices, these conductive portions forming the links between the switches and the tripping devices.

The invention will be better understood and other advantages thereof will emerge more clearly in light of the description that follows for a circuit breaker in accordance with the principle thereof, which is provided with reference to the appended drawings, in which.

Figure 1:
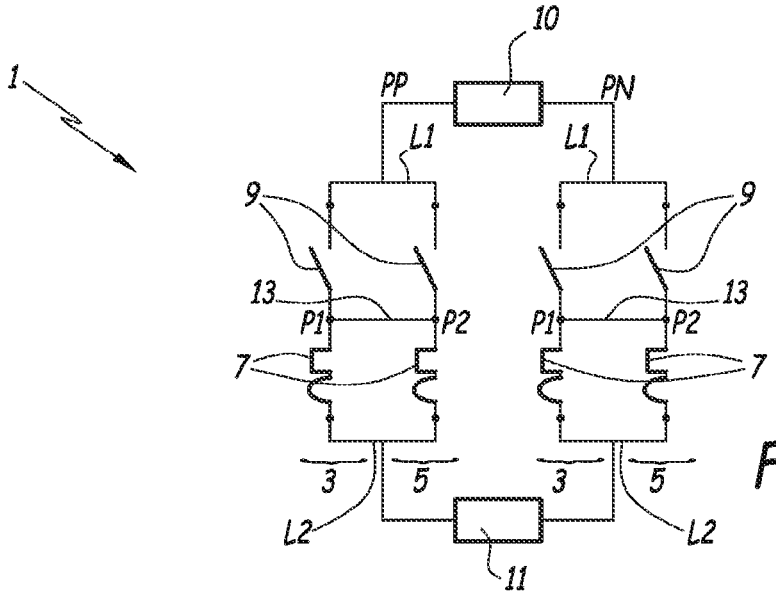
FIG. 1 is an electrical diagram of a circuit breaker according to the invention.

FIG. 1 shows a circuit breaker 1. The circuit breaker 1 comprises a positive polarity PP and a negative polarity PN that are connected to a power source 10. Each polarity includes two respective poles 3 and 5. Each of the poles 3 and 5 comprises a tripping device 7 and a switch 9. The tripping device 7 and the switch 9 are connected in series. The polarities PP and PN are connected to a load 11 that is connected to the tripping devices 7. The poles 3 and 5 are connected in parallel by an electrical link L1 on the source 10 side and by an electrical link L2 on the load 11 side. In FIG. 1, the circuit breaker 1 is shown to be open.

The object of the invention is to prevent variations in the contact resistances of the switches 9 from causing imbalances in the intensity of the current in the tripping devices 7 of two poles of one and the same polarity. To this end, the poles 3 and 5 are connected, between the tripping device 7 and the switch 9, by an equalizer 13 electrically connecting the link between the tripping device 7 and the switch 9 of the pole 3, and the link between the tripping device 7 and the switch 9 of the pole 5. The link between the switch 9 and the tripping device 7 of the pole 3 is represented by the point P1 in FIG. 1. The link between the switch 9 and the tripping device 7 of the pole 5 is represented by the point P2 in FIG. 1. The links represented by the points P1 and P2 are, in practice, connecting interfaces between the tripping devices 7 and the switches 9, said connecting interfaces being formed by conductive portions belonging to the tripping devices 7 and to the switches 9.

The equalizer 13 allows the potentials of the points P1 and P2 to be made equal. Thus, the distribution of the current in the switches 9 does not affect the distribution of the currents in the tripping devices 7. Moreover, the resistances of the tripping devices 7 are equivalent to the resistances of the conductive portions making up the tripping devices 7, and the resistance of these portions is known and well under control. The distribution of the intensity of the current in the respective tripping devices 7 of the poles 3 and 5 is therefore substantially equal, which prevents the circuit breaker 1 from tripping for intensity current values below the maximum tripping current value.

In theory, the resistance of the equalizers 13 must be zero for the balance of the intensities in the tripping devices 7 of the poles 3 and 5 connected in parallel to be perfect, but this condition is impossible to produce. In practice, it suffices for the value of the resistance of the equalizer 13 to be no more than of the same order of magnitude as the resistance of the tripping devices 7 of the poles 3 and 5 connected in parallel in order for the balance of the currents to be significantly improved. Same order of magnitude is intended to be understood to mean that the value of the resistance of the equalizer 13 is less than approximately three times that of the resistance of the tripping devices 7. By way of example, if the resistance of the tripping devices 7 is 25 micro-Ohms, the resistance of the equalizers 13 must be less than 75 micro-Ohms. The lower the resistance of the equalizer 13 in comparison with the resistance of the tripping device 7, the better the balance of the currents will be. Preferably, the value of the resistance of the equalizer 13 must be lower than the value of the resistance of the tripping devices 7.

Figure 2:
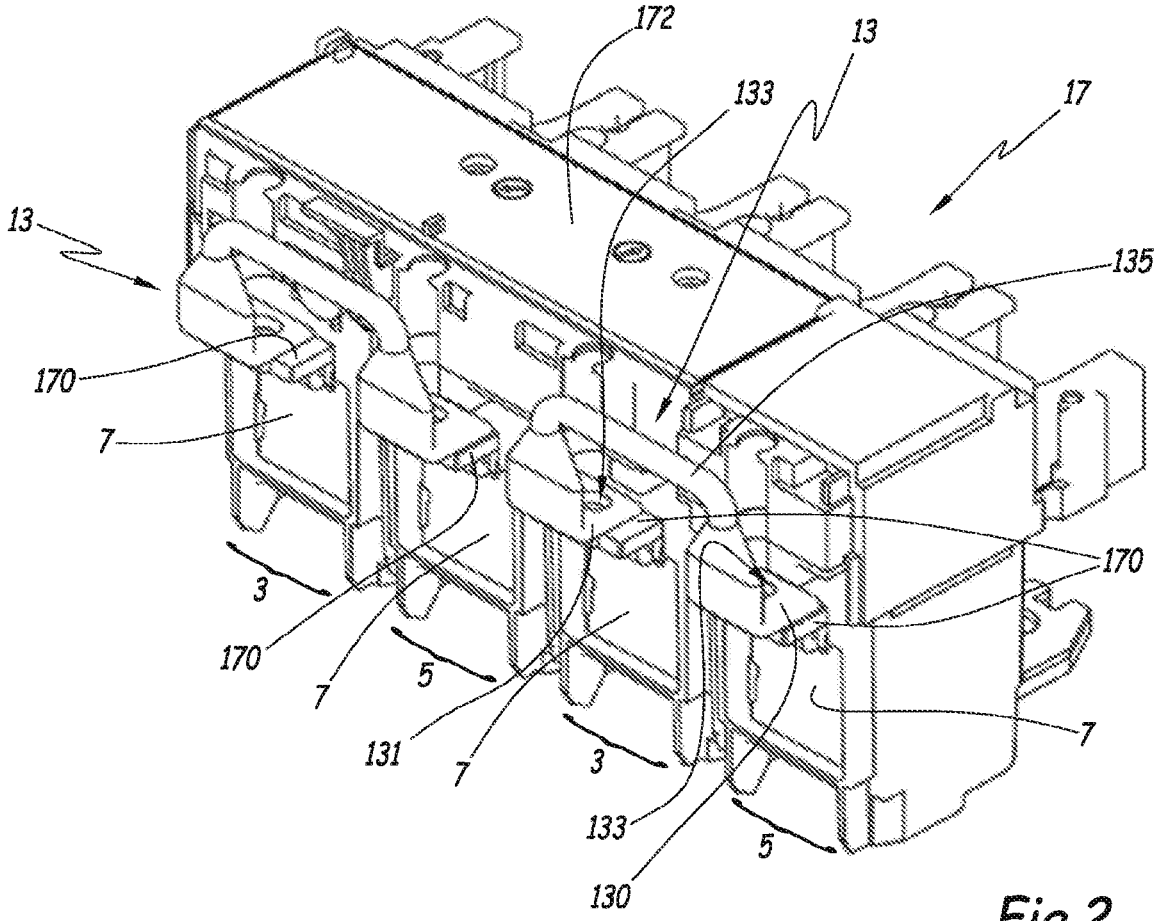
FIG. 2 is a perspective view of a portion of the circuit breaker of FIG. 1.

As shown in FIG. 2, the equalizer 13 can be implemented in the form of a conductive bow formed by a rigid mechanical portion comprising a central part 135 and two terminals formed by fixing lugs 130 and 131 provided with holes 133. The conductive bow 13 can be fixed by screws, which are not shown. The conductive bow 13 can be produced by forging or by hot forming.

Figure 3:
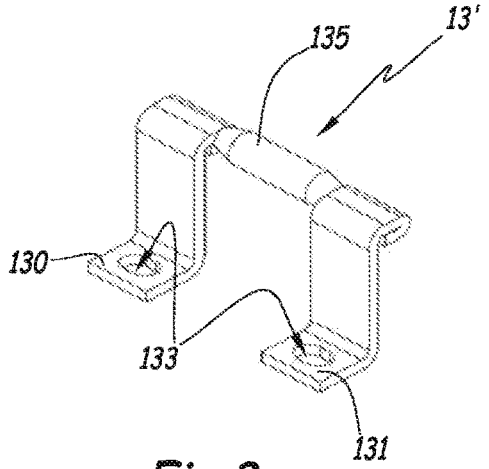
FIGS. 3 and 4 are perspective views of two different types of equalizer belonging to the circuit breaker of FIGS. 1 and 2.

FIG. 3 shows a bow 13' in accordance with a variant of the invention. The bow 13' can comprise a central part 135 made up of a conductive braid or a section of cable and fixing and connecting lugs 130 and 131 as a result of the folding of a metal plate, which are connected to the central part 135, for example by welding or by crimping.

Figure 4:
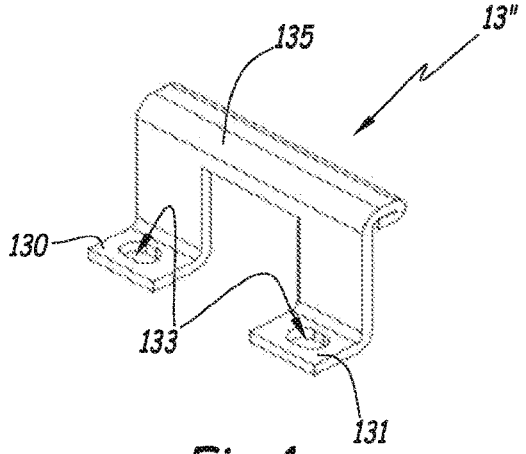

FIG. 4 shows a bow 13" in accordance with another variant of the invention. The bow 13" is entirely made up of a metal plate that has been cut and folded.

FIG. 2 shows the part of the circuit breaker 1 that comprises the tripping devices 7. Four tripping devices 7 belonging to each of the poles 3 and 5 of the polarities PP and PN are grouped in parallel into a tripping block 17.

In the embodiment of FIGS. 1 and 2, the bows 13 are mounted on the tripping block 17, that is to say on the conductive portions of the tripping devices 7 that form the links between the tripping devices 7 and the switches 9. Each tripping device 7 comprises a fixing and connecting lug 170, which is electrically connected to the conductive portions of this tripping device 7, and which forms the electrical link to the switch 9 of the corresponding pole 3 or 5. Each bow 13 is fixed to two adjacent lugs 170 belonging to the poles 3 and 5, respectively. The fixing lugs 170 project outside the tripping block 17, and the central part 135 of the bows 13 is outside the tripping block 17.

Figure 5:
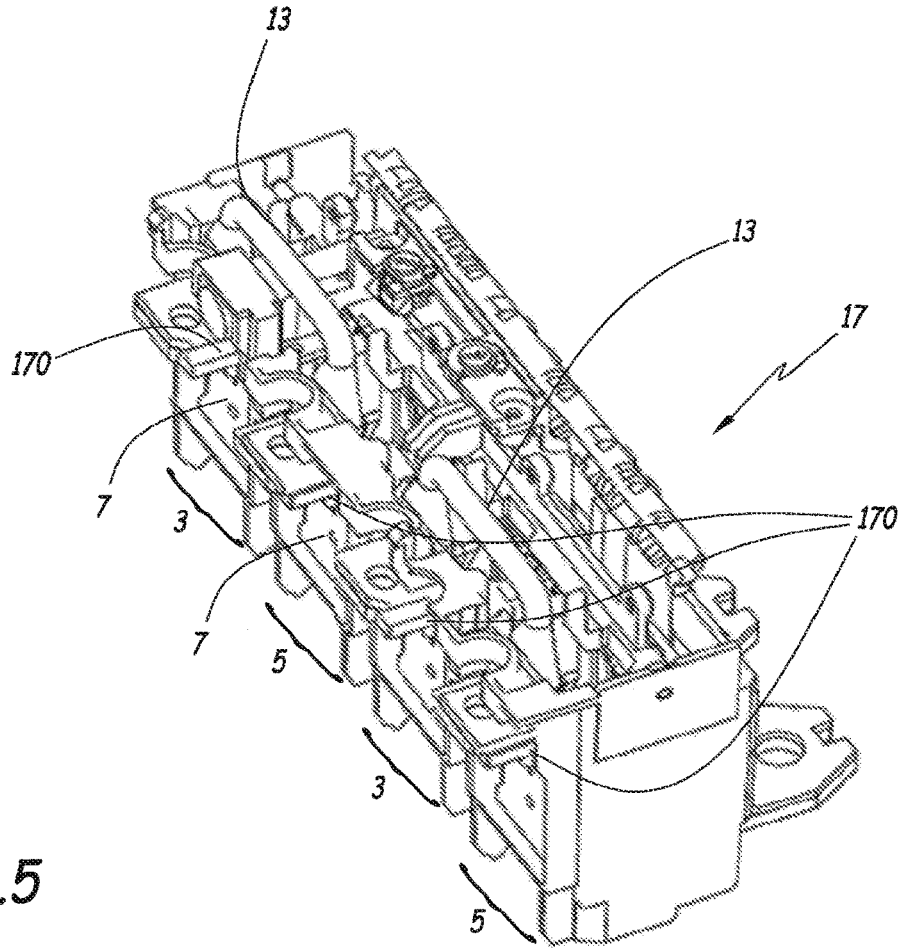
FIG. 5 is a perspective view of a portion of the circuit breaker of FIG. 1 according to preferred embodiment.

A preferred embodiment of the invention is shown in FIG. 5. In FIG. 5, an upper cover 172 of the tripping block 17 of FIG. 2 has been removed, making the inside of the tripping block 17 visible. The bows 13 are mounted inversely in relation to FIG. 2, the central part 135 of the bows 13 being inside the tripping block 17.

Figure 6:
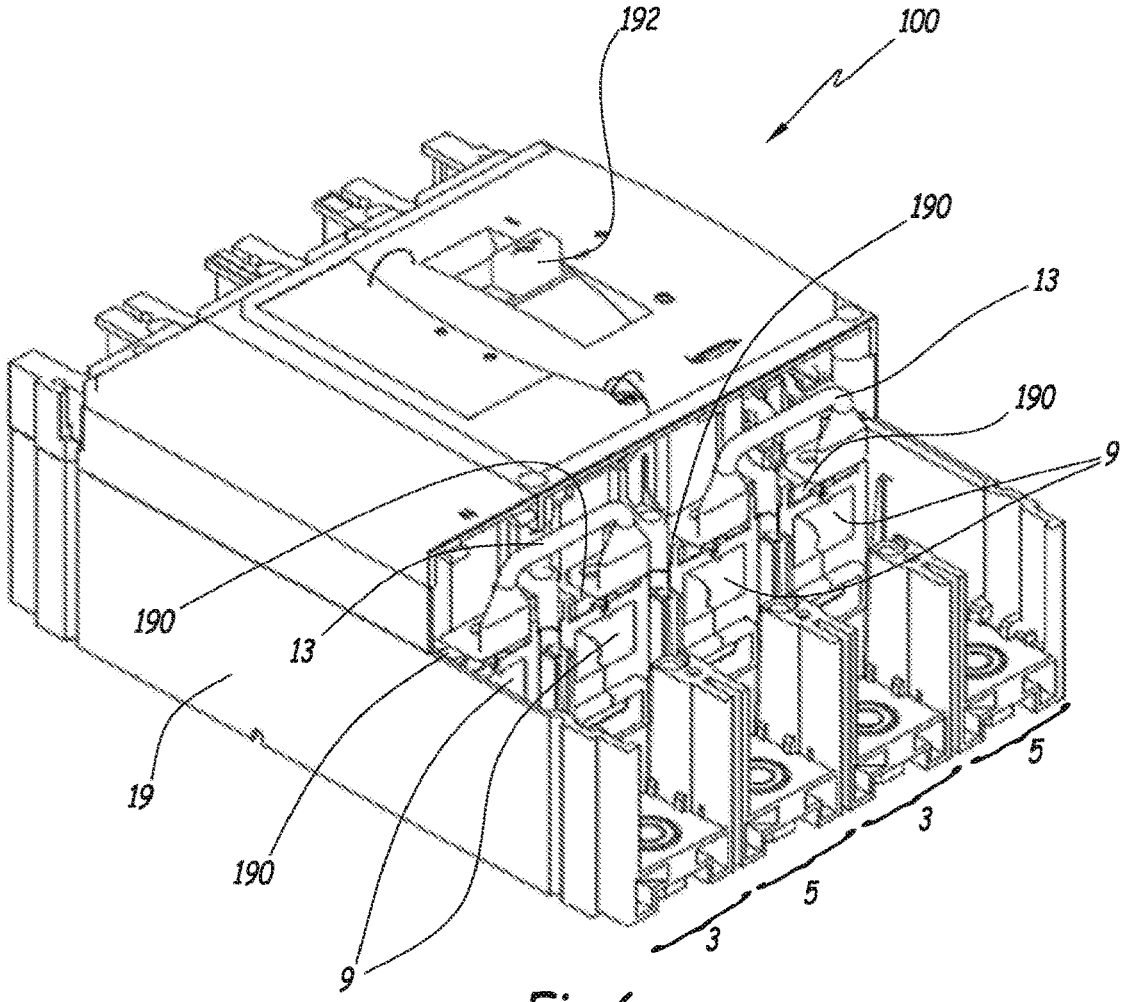
FIG. 6 is a perspective view of a portion of a circuit breaker according to a second embodiment of the invention.
Figure 7:
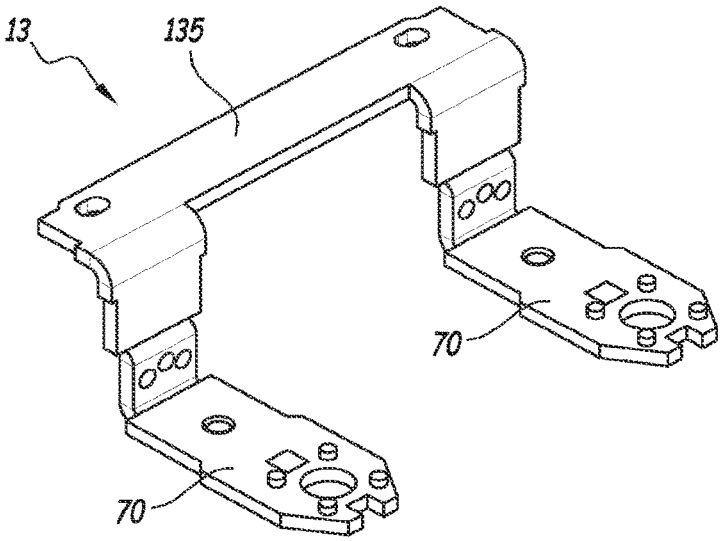
FIG. 7 is a perspective view of an equalizer belonging to a circuit breaker according to a third embodiment of the invention.

A second and a third embodiment of the invention are shown in FIGS. 6 and 7, respectively. In these embodiments, the elements that are similar to those of the first embodiment bear the same references and work in the same way. Only the differences in relation to the first embodiment are detailed below.

FIG. 6 shows the part of a circuit breaker 100 in accordance with a third embodiment of the invention that comprises the switches 9. The four switches 9 belonging to each of the poles 3 and 5 are grouped in parallel into a switching block 19 that is suited to receiving a tripping block similar to the tripping block 17. The switching block 19 comprises a control 192 that toggles when the circuit breaker 100 is tripped, and which can be actuated manually by a person in order to reset the circuit breaker 100 and reapply voltage to the installation.

In the embodiment of FIG. 6, the bows 13 are mounted on the switching block 19, that is to say on the conductive portions of the switches 9 that form the links between the switches 9 and the tripping devices 7. Each switch 9 comprises a fixing and connecting lug 190 which is electrically connected to the conductive portions of this switch 9, and which form the electrical link to the tripping device 7 of the corresponding pole 3 or 5. Each bow 13 is fixed to two adjacent lugs 190 belonging to the poles 3 and 5, respectively.

In the embodiment of FIG. 7, the equalizer 13 is formed by a bow having lateral branches formed by conductive portions 70 of two adjacent tripping devices 7. In such a case, the equalizer 13 can be formed by a single metal portion, or even by the securing of two conductive portions 70 by a central part 135 that is attached, by way of example, by welding.

According to an embodiment that is not shown, the equalizers 13 can likewise be produced in the form of cables or of braids of conductive wires.

The features of the embodiments and variants described above can be combined in order to create new embodiments of the invention.

The invention claimed is:

1. A circuit breaker comprising:

a first link having a first polarity; and a second link having a second polarity that is opposite the first polarity, each of the first link and the second link including two poles connected in parallel, each pole having a switch and a tripping device, wherein each of the first link and the second link has an equalizer electrically connecting a link between the switch and the tripping device of a first pole and a link between the switch and the tripping device of the second pole, wherein the circuit breaker is partitioned into tripping blocks, each tripping block including a housing and four tripping devices each belonging to a pole, and wherein each tripping device further includes a fixing and connecting lug, electrically connected to the conductive portions of the tripping device, that forms the electrical link to the switch of each pole and projects outside the tripping block housing.

2. The circuit breaker according to claim 1, wherein the equalizers are cables or braids of conductive wires.

3. The circuit breaker according to claim 1, wherein the equalizers are fixed to conductive portions of the tripping devices that form the links between the switches and the tripping devices.

4. The circuit breaker according to claim 1, wherein the equalizers are fixed to conductive portions of the switches that form the links between the switches and the tripping devices.

5. The circuit breaker according to claim 1, wherein the equalizer is a bow comprising lateral branches formed by conductive portions of two adjacent tripping devices, these conductive portions forming the links between the switches and the tripping devices.

6. The circuit breaker according to claim 1, wherein the equalizer is a conductive bow forged from a folded metal plate and includes a central conductive braid affixed onto a connecting lug on each end, the equalizer being forged in the shape of a handle.

7. The circuit breaker according to claim 1, wherein an equalizer connected to the fixing and connecting lug has at least a portion of the equalizer outside the tripping block housing.

8. The circuit breaker according to claim 1, wherein the value of the resistance of the equalizer is no more than at the same order of magnitude as the value of the resistance of each of the tripping devices.

9. The circuit breaker according to claim 8, wherein the value of the resistance of the equalizer is less than three times the value of the resistance of each of the tripping devices.

10. The circuit breaker according to claim 1, wherein the equalizer is a conductive bow.

11. The circuit breaker according to claim 10, wherein the conductive bow has two fixing lugs provided with hole.

12. The circuit breaker according to claim 11, wherein the conductive bow is fixed by screws.

* * * * *